US012677895B1

(12) United States Patent
Chen et al.

(10) Patent No.: US 12,677,895 B1
(45) Date of Patent: Jul. 14, 2026

(54) RAPIDLY DETACHABLE BELT WITH A NYLON-COATED STEEL SHEET STRUCTURE

(71) Applicant: Foshan Tushi Outdoor Equipment Manufacturing Co., Ltd., Foshan (CN)

(72) Inventors: Huamei Chen, Wuchuan (CN); Liming Chen, Wuchuan (CN)

( * ) Notice: Subject to any disclaimer, the term of this patent is extended or adjusted under 35 U.S.C. 154(b) by 0 days.

(21) Appl. No.: 19/269,124

(22) Filed: Jul. 15, 2025

(51) Int. Cl.
*A41F 9/02* (2006.01)
*A44B 11/24* (2006.01)

(52) U.S. Cl.
CPC ..... *A41F 9/025* (2013.01); *A41F 9/02* (2013.01); *A44B 11/24* (2013.01)

(58) Field of Classification Search
CPC ..... A41F 9/025; A41F 9/02; A44B 11/24
See application file for complete search history.

(56) References Cited

U.S. PATENT DOCUMENTS 3,986,233 A * 10/1976 Stone, Jr. ..... A44B 11/22 24/182
6,725,509 B1 * 4/2004 Lee ..... A44B 11/2523 24/641
2015/0135409 A1 * 5/2015 Mongan ..... A41F 9/00 2/312
2018/0168294 A1 * 6/2018 Pandolfino ..... A44C 15/005
2019/0082796 A1 * 3/2019 Chen ..... A44B 11/2588
2021/0022455 A1 * 1/2021 Dong ..... A44B 11/006
2024/0057726 A1 * 2/2024 Chen ..... A44B 11/12

* cited by examiner

*Primary Examiner* — Khaled Annis

(57) ABSTRACT

The invention relates to the technical field of belts, disclosing a rapidly detachable belt with a nylon-coated steel sheet structure, comprising front buckle plate, belt body, rear buckle plate. One end of front buckle plate has mounting slot. Its side has retention holes communicating with the slot, each equipped with a threaded screw. Specifically, two retention holes are equidistantly provided at one end, each threaded with a screw. Rotating the screw adjusts its depth into the slot. The mounting slot is slidably coupled to one end of belt body. The screw end abuts the belt body side. The belt body's width and thickness correspond to the slot dimensions. Through the front and rear buckle plate design, magnetic blocks provide mutual adsorption. This combines with the interlocking engagement between a retention knob's limiting notch and a limiting tab within a retention sliding slot. Sliding the two plates together enables rapid detachment.

10 Claims, 7 Drawing Sheets

RAPIDLY DETACHABLE BELT WITH A NYLON-COATED STEEL SHEET STRUCTURE

TECHNICAL FIELD

The invention relates to the technical field of belt body, in particular to a rapidly detachable belt with a nylon-coated steel sheet structure.

BACKGROUND OF THE ART

As a common functional component in the apparel field, the belt is widely used for fastening trousers, workwear, and outdoor gear. Traditional belts typically adopt structures where a metal buckle pin cooperates with buckle holes or a locking mechanism for length adjustment. Such designs suffer from low detachment efficiency, requiring repeated unfastening or unlocking during each wear. Particularly for belts with locking mechanisms, the adjusted waist circumference length often varies between wears, which may result in user discomfort and necessitate repeated readjustments, presenting inherent drawbacks.

SUMMARY

I. Technical Problems Solved

In view of the limitations of prior art, the present invention provides a rapidly detachable belt with a nylon-coated steel sheet structure. This design offers advantages such as improved detachment speed and elimination of repeated readjustments after initial fitting to a proper waist circumference, thereby solving the problems of slow detachment and the need for repeated length adjustments during each time of wearing in conventional belts.

II. Technical Solution

To achieve the above objectives, the present invention provides the following technical solution: A rapidly detachable belt with a nylon-coated steel sheet structure comprises front buckle plate, belt body, and rear buckle plate. One end of front buckle plate is provided with mounting slot. A side surface of front buckle plate is provided with retention holes communicating with the mounting slot, each retention hole being threadedly connected with a screw. Specifically, two retention holes are equidistantly arranged at one end on front side of front buckle plate, each threadedly connected with screw. By rotating screw clockwise or counterclockwise, the depth to which screw penetrates into mounting slot can be adjusted.

Mounting slot is slidably sleeved over one end of the belt body. The end of screw abuts against a corresponding position on the side surface of belt body. The width and thickness of belt body correspond precisely to the dimensions of the mounting slot. By inserting one end of belt body into the mounting slot and rotating the screw head, screw shank gradually advances into mounting slot and presses tightly against the corresponding position on the side surface of belt body, thereby securing belt body to front buckle plate.

The back surface of front buckle plate is provided with groove I; a connection slot is formed within groove I; and a front magnetic block is fixedly arranged within the connection slot.

Rear buckle plate is movably connected to the back surface of front buckle plate. The front side of rear buckle plate is provided with groove II (301). A mounting housing is disposed within groove II. Rear magnetic block is fixed within the mounting housing. Rear magnetic block is positioned opposite to front magnetic block. The mounting housing is located at the central position within groove II. Rear magnetic block, whose dimensions correspond precisely to those of the mounting housing, is installed within it. When front buckle plate and rear buckle plate are closed against each other, front magnetic block and rear magnetic block are brought into opposition, whereby they are magnetically attracted and secured.

Oppositely arranged on both sides of the back surface of rear buckle plate are side plates. Guide plate and limiting tab are respectively fixed at both ends of each side plate. Locking mechanism is movably connected within limiting tab. Guide plate serves to guide one end of belt body through the space between the back surface of rear buckle plate and guide plate. Consequently, during the continuous guiding process, the belt end can stably pass through limiting tab and be locked and secured by the locking mechanism.

A steel sheet is slidably sleeved within the belt body. The steel sheet is specifically made of stainless steel material, enabling it to be magnetically attracted and secured by magnetic objects. Furthermore, the steel sheet possesses a certain degree of flexibility, allowing it to freely bend. Consequently, the belt can fit securely and comfortably around the user's waist.

Furthermore, during the disassembly process, the resilient rebound force generated by the flexibility of the steel sheet can be utilized to propel apart the separated front buckle plate and rear buckle plate, thereby increasing the detachment speed of the belt.

When using this rapidly detachable belt, one end of the belt body is inserted into the mounting slot. A screw is inserted into a retention hole and rotated, causing the tip of the screw shank to press tightly against the corresponding position on the side surface of the belt body, thereby securing that end of the belt body to the front buckle plate. Subsequently, the rear buckle plate is magnetically attached to the rear side of the front buckle plate via mutual magnetic attraction. The other end of the belt body is then guided through the space between the back surface of the rear buckle plate and the guide plate, passed through the limiting tab, and pulled taut to the desired tightness. At this point, it is locked and secured by the locking mechanism. For rapid detachment, the front buckle plate and rear buckle plate are pushed in opposite directions. This simultaneously disengages the limiting notch on the retention knob from the limiting tab and causes it to ascend along the oblique section, allowing the magnetic blocks to separate, thus completing disassembly.

As a further improvement of the above solution, oblique section I is provided on the front buckle plate at one end of groove I.

Rear buckle plate is formed with oblique section II located at one end of groove II.

The opposing faces of oblique section I and oblique section II are parallel.

Through the above technical solution, when the front buckle plate and rear buckle plate are closed, oblique section I and oblique section II oppose each other in flush contact. During separation, the front buckle plate slides along the oblique section II to detach from the rear buckle plate. Conversely, during engagement, the front buckle plate slides along the oblique section II to merge with the rear buckle plate.

As a further improvement of the above solution, side ribs are oppositely arranged on both inner walls of the groove II. The inner walls of the groove I closely abut against the opposite outer side surfaces of these side ribs.

Through the above technical solution, during the closure or separation of the front buckle plate and rear buckle plate, the side ribs slide against the inner walls of groove I, thereby ensuring stability during the sliding connection between the front and rear buckle plates. This enables precise alignment between the front magnetic block and rear magnetic block.

As a further improvement of the above scheme, one end in the groove 1 is provided with a retaining slide, the retaining slide penetrates the surface of the front buckle plate, and at the same time, one end in the retaining slide is provided with a limiting piece.

The retention knob is fixedly provided at one end within groove II; limiting notch is formed on a side surface of retention knob.

The retention knob is movably connected within retention sliding slot, and limiting notch engages with a side surface of limiting tab.

Through the above technical solution, when the front buckle plate and rear buckle plate separate or merge via sliding, the retention knob slides within a retention sliding slot. When the limiting notch snap-engages with the lateral side of the limiting tab, this achieves locking fixation of the front and rear buckle plates after merging.

As a further improvement of the above scheme, a protruding button is disposed at one end of a rear surface of front buckle plate; guide slot is formed at one end of rear buckle plate, located within groove II; protruding button is movably coupled within the guide slot.

Through the above technical solution, during the merging or separation of the front buckle plate and rear buckle plate, a protruding button slides within a guide groove, thereby enhancing the stability of the connection between the buckle plates and preventing lateral deviation.

As a further improvement of the above scheme, the locking mechanism comprises a connecting rod rotatably connected between the side plates, and the side portion of the connecting rod is fixed with a toothed buckle.

The elongated slot is provided on a side surface of the belt body; a side portion of toothed buckle engages with a sidewall of the elongated slot.

Through the technical proposal, when the connecting rod rotates, the toothed buckle of the side part is driven to rotate at the same time, when the front end of the toothed buckle is separated from the elongated slot corresponding to the side part of the belt body, the belt body can be freely pushed and pulled to adjust the belt body waist size, and when the front end of the toothed buckle is clamped into the elongated slot corresponding to the side part of the belt body, the adjusted belt body size can be fixed.

As a further improvement of the above scheme, the side parts of both ends of the connecting rod are movably sleeved with a torsion spring, and the two ends of the torsion spring are respectively fixed between the toothed buckle and the side plate.

Through the above technical scheme, the torsion spring is used for reversely twisting the toothed buckle, so that the front end of the toothed buckle maintains the function of being engaged in the elongated slot at the corresponding position.

As a further improvement of the above scheme, a button is fixed at one end of the connecting rod, and the button is fitted to the side part of the side plate.

With the above technical solution, pressing the button actuates the connecting rod, thereby causing the toothed buckle to rotate and disengage its front end from the elongated slot, while the torsion spring contracts. Upon releasing the button, the release of torsional force from the torsion spring drives the connecting rod to rotate the toothed buckle in the reverse direction, whereupon the toothed buckle re-engages with the corresponding elongated slot.

As a further improvement of the above scheme, the steel sheet is a high manganese steel sheet.

As a further improvement of the above scheme, the wear resistance of the steel sheet is improved by quenching.

Compared with the prior art, the invention provides a rapidly disassembled belt with a nylon-coated steel sheet structure, which has the following beneficial effects:

1. Through the design of the front buckle plate and the rear buckle plate, magnetic blocks are employed for mutual adsorption. This is combined with the interlocking engagement between a limiting notch on the side of a retention knob and a limiting tab within a retention sliding slot. Sliding the two buckle plates toward each other allows for rapid detachment.

2. In this rapidly detachable belt, the front end of the belt is affixed to the front buckle plate, while the opposite end passes sequentially between the rear guard plate, guide plate, and limiting tab before being secured by a locking mechanism. After the initial adjustment to the proper waist circumference, subsequent fastening merely requires bringing the two buckle plates into contact—where magnetic blocks provide instantaneous snap-fit engagement—followed by the interlocking of a limiting notch with the lateral side of the limiting tab to achieve positive retention. For detachment, the buckle plates are slid apart in opposing directions, enabling rapid disassembly. This eliminates the need for repetitive length adjustments during each use, significantly enhancing the belt's practicality.

3. In this rapidly detachable belt, a reinforcing steel sheet is integrated to enhance the structural rigidity of the belt strap, enabling it to support suspended loads of varying weights. This construction adapts the belt for outdoor applications requiring auxiliary gear carriage.

Figure 1:
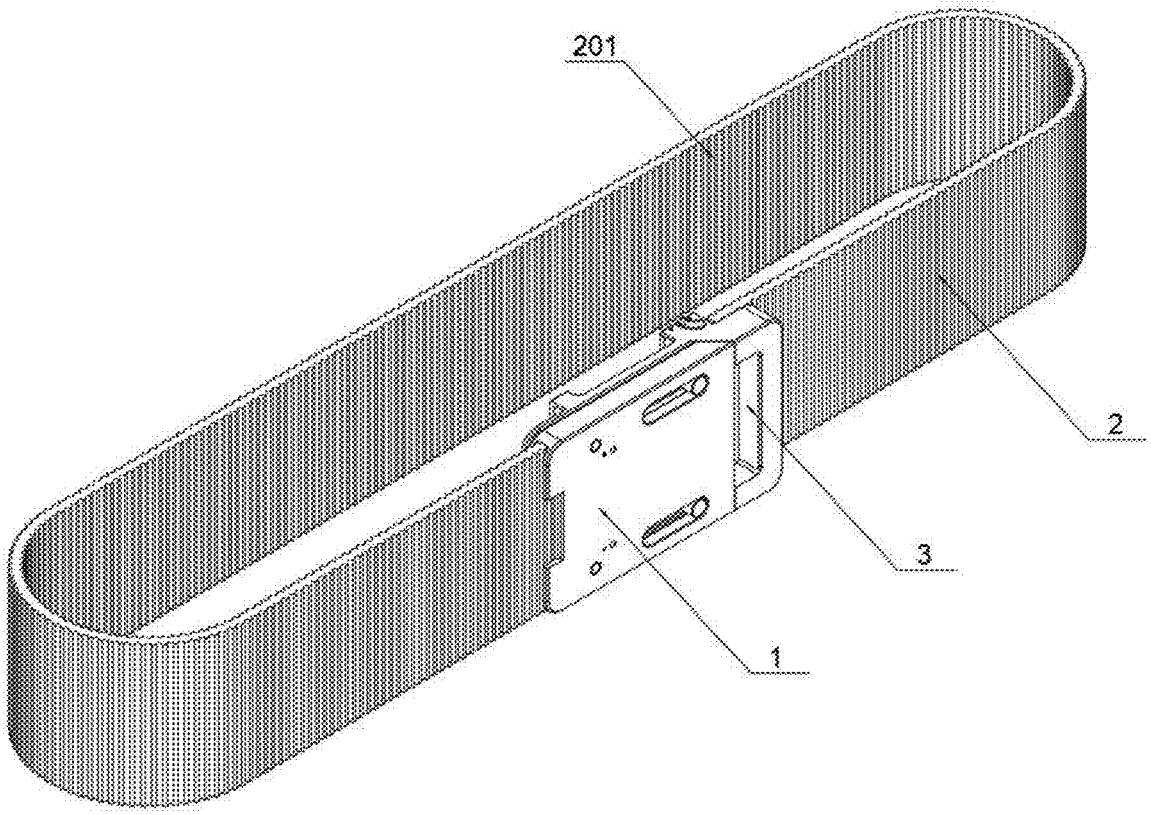
FIG. 1 is the schematic view of the overall assembly of the present invention.

In the accompanying drawings, reference numerals denote the following components:

1. front buckle plate; 100, oblique section I; 101, mounting slot; 102, retention hole; 1021, screw; 103, groove I; 104, retention slot; 105, limiting tab; 106, connection groove; 107, front magnetic block; 108, protruding button;

2. Belt body; 201, elongated slot; 202, steel sheet;

3. rear buckle plate; 301, groove II; 302 oblique section II; 303, side rib; 304, retaining button; 305, limiting notch;

306, mounting frame; 307, rear magnetic block; 308, guide groove; 309, side plate; 310, guide plate; 311, limiting tab; 32, locking mechanism; 312, connecting rod; 313, button 314, torsion spring; 315, toothed buckle.

DETAILED DESCRIPTION

With reference to the drawings in the embodiments of the present invention, the following provides a clear and complete description of the technical solutions in the embodiments of the present invention. Obviously, the described embodiment is merely part of the embodiments of the present invention and not all of them. Based on the embodiments in the present application, all other embodiments obtained by those skilled in the art without creative work fall within the scope of protection of the present application.

Embodiment 1

Figure 2:
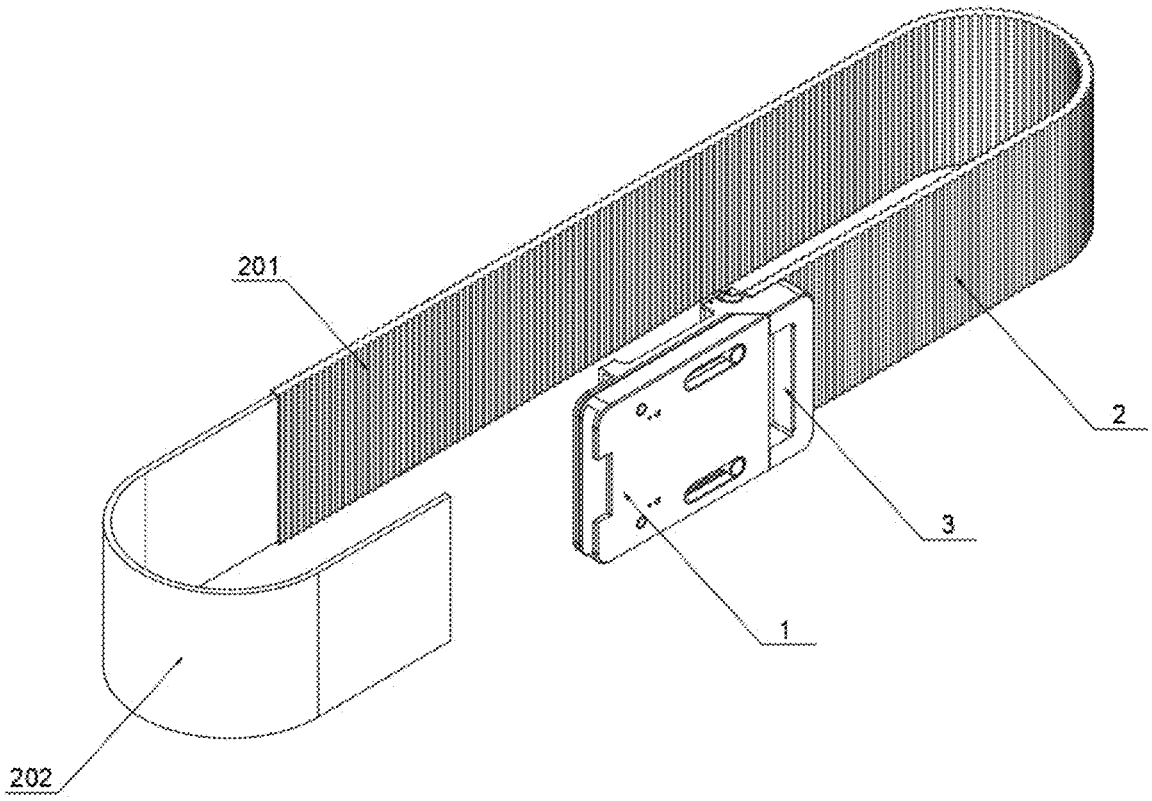
FIG. 2 is the connection structure between the belt and the steel sheet.
Figure 3:
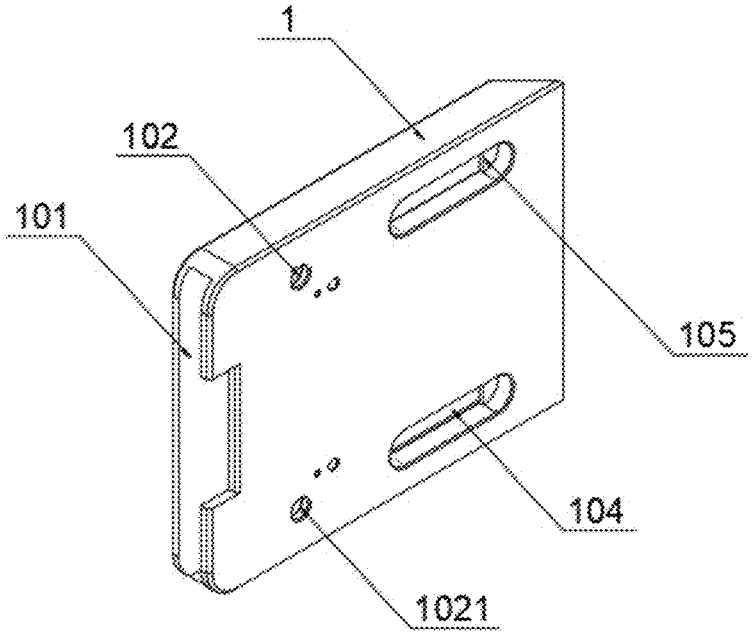
FIG. 3 is a front-side configuration of the front buckle plate.
Figure 4:
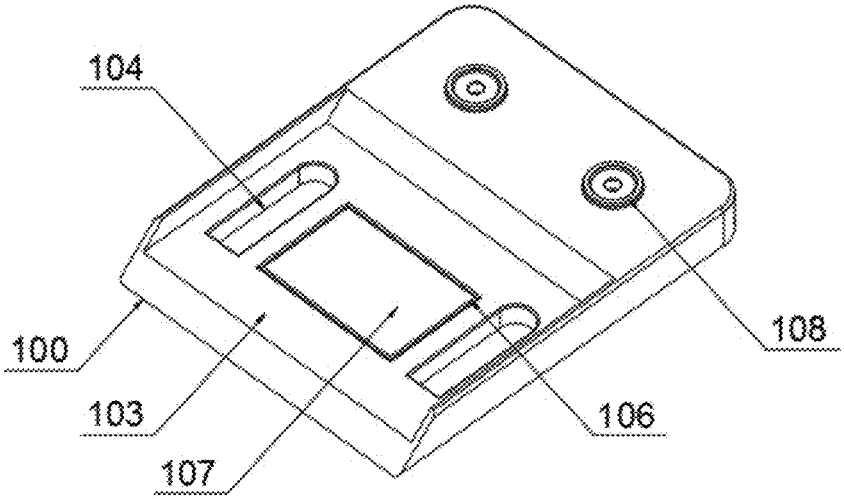
FIG. 4 is a rear-side configuration of the buckle plate assembly.
Figure 5:
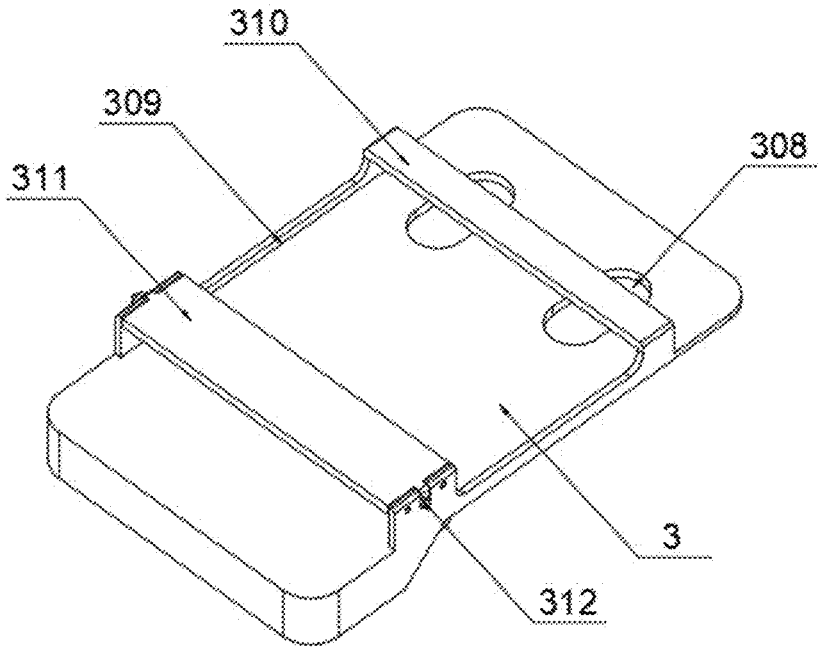
FIG. 5 is a rear-side configuration of the rear buckle plate.
Figure 6:
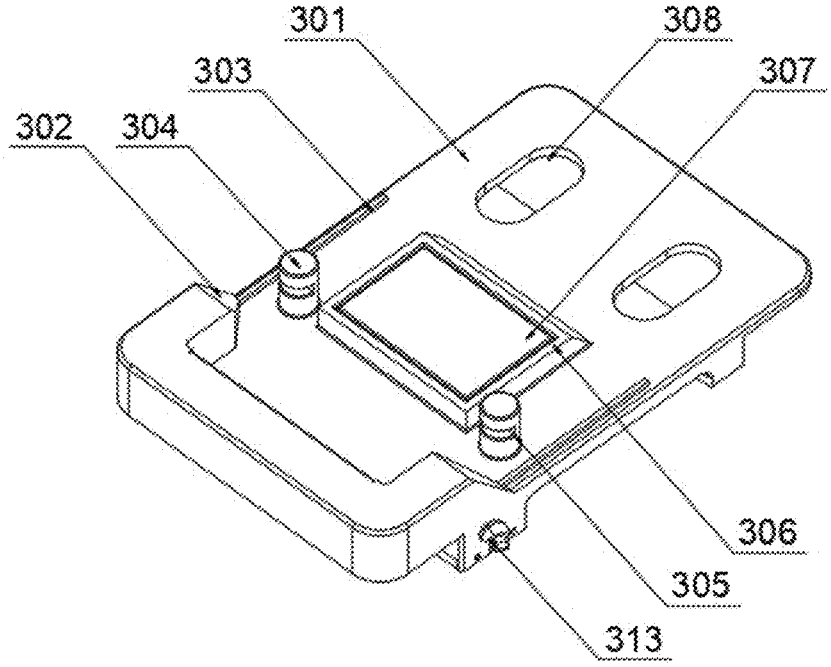
FIG. 6 is a front elevational view of the rear buckle plate assembly.
Figure 7:
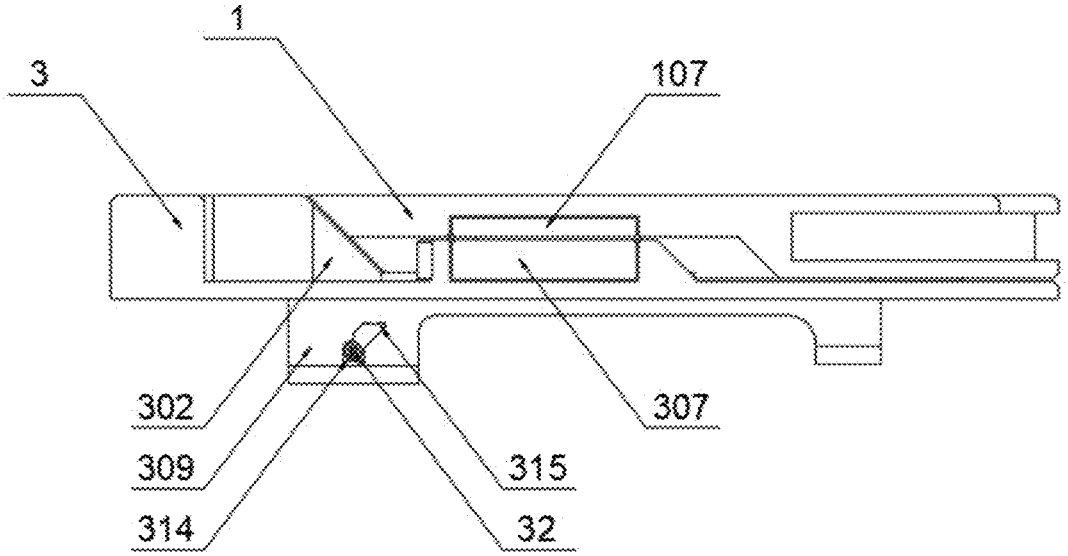
FIG. 7 is a planar sectional view of the front buckle plate and rear buckle plate.

Referring to FIGS. 1 to 7, the quickly detachable belt according to the present embodiment includes a front buckle plate 1, a belt body 2 and a rear buckle plate 3. One end of the front buckle plate 1 is provided with a mounting slot 101, and at the same time, one side of the front buckle plate 1 is provided with a retention hole 102, the retention hole 102 communicates with the installation groove 101, and the screw 1021 is internally threaded with the screw 1021.

The mounting slot 101 is slidably sleeved over one end of the belt body 2. The end of screw 1021 abuts against a corresponding position on the side surface of belt body 2. The width and thickness of belt body 2 correspond precisely to the dimensions of the mounting slot 101. By inserting one end of belt body 2 into the mounting slot 101 and rotating the screw 1021, screw 1021 shank gradually advances into mounting slot 101 and presses tightly against the corresponding position on the side surface of belt body 2, thereby securing belt body 2 to front buckle plate 1.

The back surface of front buckle plate 1 is provided with groove I 103; a connection slot 106 is formed within groove I 103; and a front magnetic block 107 is fixedly arranged within the connection slot 106;

The rear buckle plate 3 is movably connected to the back surface of front buckle plate 3. The front side of rear buckle plate is provided with groove II 301. A mounting frame 306 is disposed within groove II 301. Rear magnetic block 307 is fixed within the mounting frame 306. Rear magnetic block 307 is positioned opposite to front magnetic block 107. The mounting frame 306 is located at the central position within groove II 301. Rear magnetic block 107, whose dimensions correspond precisely to those of the mounting frame 306, is installed within it. When front buckle plate 107 and rear buckle plate 3 are closed against each other, front magnetic block 107 and rear magnetic block 307 are brought into opposition, whereby they are magnetically attracted and secured.

Oppositely arranged on both sides of the back surface of the rear buckle plate 3 are side plates 309. A guide plate 310 and a limiting tab 311 are respectively fixed at both ends of each side plate 309. The locking mechanism 32 is movably connected within the limiting tab 311. The guide plate 310 serves to guide one end of the belt body 2 through the space between the back surface of the rear buckle plate 3 and the guide plate 310. Consequently, during continuous guiding, the belt strap 2 can stably pass through the limiting tab 311 and be locked by the locking mechanism 32.

It should be further explained that one end of belt body 2 is slidably sandwiched between rear buckle plate 3 and the combination of guide plate 310 and limit plate 311; and locking mechanism 32 is configured to adjust the length of belt body 2 and retain the adjusted length;

A steel sheet 202 is slidably sleeved within the belt body 2. The steel sheet 202 is specifically made of stainless steel material, enabling it to be magnetically attracted and secured by magnetic objects. Furthermore, the steel sheet possesses a certain degree of flexibility, allowing it to freely bend. Consequently, the belt can fit securely and comfortably around the user's waist.

Further, in the detachment process, the separated front buckle plate 1 and rear buckle plate 3 can be pulled apart by the flexible rebound biasing force of the steel sheet 202, thereby improving the detachment speed of the belt body.

The working principle of the belt body that can be quickly disassembled is: when in use, by inserting one end of the belt body 2 into the installation groove 101, and inserting the screw 1021 into the retention hole 102, and rotating the screw 1021, the front end of the screw 1021 is tightly attached to the corresponding position of the side part of the belt body 2, realizing the fixation of one end of the belt body 2 and the front buckle plate 1, and then the other end of the belt body 2 passes through the rear side of the front buckle plate 3 between the rear side of the front buckle plate 3 and the guide plate 310 and the limit plate 311, and tightening to the appropriate tightness.

Embodiment 2

Referring to FIGS. 1 to 7, the rapidly detachable belt according to the present embodiment is based on the first embodiment, and the present embodiment further includes an oblique section 100 is formed on the front buckle plate 1 at one end of the groove I 103.

The rear buckle plate 3 is formed with oblique section II 302 located at one end of groove II 301.

The opposing faces of oblique section I 100 and oblique section II 302 are parallel.

More specifically, when the front buckle plate 1 and rear buckle plate 3 are closed, oblique section I 100 and oblique section II 302 oppose each other in flush contact. During separation, the front buckle plate 1 slides along the oblique section II 302 to detach from the rear buckle plate 3. Conversely, during engagement, the front buckle plate 1 slides along the oblique section II 302 to merge with the rear buckle plate 3.

Further, side rib 303 are oppositely provided on both sides of the groove II 301, and both sides of the groove II 103 are attached to the outer side surfaces opposite to the side rib 303.

More specifically, when the front buckle plate 1 and the rear buckle plate 3 are closed or separated, the side ribs 303 slides on the inner walls of the groove I 103 to ensure the stability of the sliding connection between the front buckle plate 1 and the rear buckle plate 3, so that the front magnetic block 107 and the rear magnetic block 307 are accurately aligned.

Further, one end of the groove I 103 is provided with a retaining slide 104, the retaining slide 104 penetrates the surface of the front buckle plate 1, and at the same time, one end of the retaining slide 104 is provided with a limiting piece 105.

The retention knob 304 is fixedly provided at one end within groove II 301; limiting notch 305 is formed on a side surface of retention knob 304.

The retention knob 304 is movably connected within retention sliding slot 104, and limiting notch 305 engages with a side surface of limiting tab 105.

More specifically, through the above technical solution, when the front buckle plate 1 and rear buckle plate 3 separate or merge via sliding, the retention knob 304 slides within a retention sliding slot 104. When the limiting notch 305 snap-engages with the lateral side of the limiting tab 105, this achieves locking fixation of the front buckle plate 1 and rear buckle plates 3 after merging.

Critically, during buckle assembly, the front buckle plate 1 and rear buckle plate 3 slide along the inclined interface until their mating surfaces achieve full contact. This positions the retention knob 304 within the retention sliding slot 104. Continued sliding brings the front magnetic block 107 into alignment with the rear magnetic block 307, inducing magnetic attraction. Concurrently, the limit catch 305 on the lateral side of the retention knob 304 engages the stopper tab 105. This dual-locking mechanism prevents plate separation under compressive forces that could displace the magnetic blocks. The structural design ensures that under compression, counter-displacement of the front 1 and rear buckle plates 3 occurs. This actively enhances interlock rigidity between the limit notch 305 and stopper tab 105.

When separating, the front buckle plate 1 and the rear buckle plate 3 can be separated by pushing the front buckle plate 1 and the rear buckle plate 3 in opposite directions and sliding along the oblique section until the limit notch 305 is separated from the limit tab 105.

Further, a protruding button 108 is disposed at one end of a rear surface of front buckle plate 1; guide slot 301 is formed at one end of rear buckle plate 3, located within groove II 301; protruding button is movably coupled within the guide slot 308.

More specifically, when the front buckle plate 1 and the rear buckle plate 3 are merged and separated, the protruding button 108 is caused to slide in the guide groove 308, thereby improving the stability of the connection between the buckle plate plates and preventing lateral deviation.

Further, locking mechanism 32 comprises a connecting rod 312 rotatably connected between side plates 309, toothed buckle 315 is fixed to a side surface of connecting rod 312.

The elongated slot 201 is provided on a side surface of belt body 2; a side portion of toothed buckle 315 engages with a sidewall of the elongated slot 201.

More specifically, when the connecting rod 312 rotates, the toothed buckle 315 of the side part is driven to rotate at the same time, when the front end of the toothed buckle 315 is separated from the elongated slot 201 corresponding to the side part of the belt body 2, the belt body 3 can be freely pushed and pulled to adjust the belt body waist size, and when the front end of the toothed buckle 315 is clamped into the elongated slot 201 corresponding to the side part of the belt body 2, the adjusted belt body size can be fixed.

Further, the side parts of both ends of the connecting rod 312 are movably sleeved with a torsion spring 314, and the two ends of the torsion spring 314 are respectively fixed between the toothed buckle 315 and the side plate 309.

More specifically, the torsion spring 314 is used for reversely twisting the toothed buckle 315, so that the front end of the toothed buckle 315 maintains the function of being engaged in the elongated slot 201 at the corresponding position.

Further, a button 313 is fixed to one end of the connecting rod 312, and the button 313 is fitted to the side portion of the side plate 309.

More specifically, pressing the button 313 actuates the connecting rod 312, thereby causing the toothed buckle 315 to rotate and disengage its front end from the elongated slot 201, while the torsion spring 314 contracts. Upon releasing the button, the release of torsional force from the torsion spring 314 drives the connecting rod 312 to rotate the toothed buckle 315 in the reverse direction, whereupon the toothed buckle 315 re-engages with the corresponding elongated slot 201.

Embodiment 3

The belt of the present application is provided with a steel sheet, the steel sheet increases the strength of the belt itself, and can hang different heavy objects on the belt, such as kettles, outdoor appliances, protective articles, etc., so as to be convenient for outdoor use.

Although embodiments of the present application have been shown and described, it will be understood by those of ordinary skill in the art that various changes, modifications, substitutions, and variations can be made to these embodiments without departing from the principles and spirit of the present application, the scope of which is defined by the appended claims and their equivalents.

The invention claimed is:

1. A rapidly detachable belt with a nylon-coated steel sheet structure, comprising a front buckle plate (1), a belt body (2), and a rear buckle plate (3), characterized in that: one end of the front buckle plate (1) is provided with a mounting slot (101); a side surface of the front buckle plate (1) is provided with a retention hole (102), the retention hole (102) being in communication with the mounting slot (101), and a screw (1021) is threadedly engaged within the retention hole (102);

the mounting slot (101) being slidably sleeved over one end of the belt body (2); and an end of the screw (1021) abutting against a corresponding position on a side surface of the belt body (2);

a back surface of the front buckle plate (1) being provided with a groove I (103); a connection slot (106) being formed within the groove I (103); and a front magnetic block (107) being fixedly arranged within the connection slot (106);

the back surface of the front buckle plate (1) being slidably connected to the rear buckle plate (3); a front side of the rear buckle plate (3) being provided with a groove II (301); a mounting frame (306) being arranged within the groove II (301); a rear magnetic block (307) being fixedly arranged within the mounting frame (306); and the rear magnetic block (307) and the front magnetic block (107) being positioned opposite to each other;

opposite sides of a back surface of the rear buckle plate (3) being oppositely disposed with side plates (309); a guide plate (310) and a limit plate (311) being respectively fixed at two ends of each side plate (309); and a locking mechanism (32) being movably connected within the limit plates (311);

one end of the belt body (2) being slidably sandwiched between the rear buckle plate (3) and the guide plate (310) and the limit plate (311); the locking mechanism (32) being configured to adjust a length of the belt body (2) and retain the adjusted length;

the belt body (2) internally having a steel sheet (202) slidably sleeved therein.

2. The rapidly detachable belt with a nylon-coated steel sheet structure according to claim 1, characterized in that an oblique surface I (100) is provided on the front buckle plate (1) at one end of the groove I (103); the rear buckle plate (3) is formed with an oblique section II (302) located at one end of the groove II (301); and opposing faces of the oblique surface I (100) and the oblique section II (302) are parallel.

3. The rapidly detachable belt with a nylon-coated steel sheet structure according to claim 1, characterized in that side ribs (303) are oppositely disposed on both inner sides of the groove II (301); and both inner sides of the groove I (103) abut against opposite outer sides of the side ribs (303).

4. The rapidly detachable belt with a nylon-coated steel sheet structure according to claim 1, characterized in that a retention sliding slot (104) is formed at one end within the groove I (103); the retention sliding slot (104) penetrating through a surface of the front buckle plate (1); a limiting tab (105) being disposed at one end within the retention sliding slot (104); a retention knob (304) being fixedly provided at one end within the groove II (301); a limiting notch (305) being formed on a side surface of the retention knob (304); and the retention knob (304) being movably connected within the retention sliding slot (104), and the limiting notch (305) engages with a side surface of the limiting tab (105).

5. The rapidly detachable belt with a nylon-coated steel sheet structure according to claim 1, characterized in that a protruding button (108) is disposed at one end of a rear surface of the front buckle plate (1); a guide slot (308) is formed at one end of the rear buckle plate (3) within the groove II (301); and the protruding button (108) is movably coupled within the guide slot (308).

6. The rapidly detachable belt with a nylon-coated steel sheet structure according to claim 1, characterized in that the locking mechanism (32) comprises a connecting rod (312) rotatably connected between the side plates (309); a toothed buckle (315) being fixed to a side surface of the connecting rod (312); an elongated slot (201) being provided on a side surface of the belt body (2); and a side portion of the toothed buckle (315) engaging with a sidewall of the elongated slot (201).

7. The rapidly detachable belt with a nylon-coated steel sheet structure according to claim 6, characterized in that a torsion spring (314) is movably sleeved over each end portion of the connecting rod (312); and two ends of the torsion spring (314) are respectively secured to the toothed buckle (315) and the side plate (309).

8. The rapidly detachable belt with a nylon-coated steel sheet structure according to claim 7, characterized in that a knob (313) is fixed to one end of the connecting rod (312); and the knob (313) abuts against a side surface of the side plate (309).

9. The rapidly detachable belt with a nylon-coated steel sheet structure according to claim 1, characterized in that the steel sheet (202) is a high-manganese steel sheet.

10. The rapidly detachable belt with a nylon-coated steel sheet structure according to claim 1, characterized in that wear resistance of the steel sheet (202) is enhanced by quenching.

* * * * *